United States Patent [19]

Hara et al.

[11] Patent Number: 4,876,578

[45] Date of Patent: Oct. 24, 1989

[54] PAPER SEPARATION CHARGER FOR USE IN ELECTROPHOTOGRAPHIC COPIER AND THE LIKE

[75] Inventors: Kazuyoshi Hara; Masataka Oda, both of Osaka, Japan

[73] Assignee: Minolta Camera Kabushiki Kaisha, Osaka, Japan

[21] Appl. No.: 195,676

[22] Filed: May 18, 1988

[30] Foreign Application Priority Data

May 18, 1987 [JP] Japan ..... 62-120781

[51] Int. Cl.[4] ..... G03G 15/14

[52] U.S. Cl. ..... 355/315; 361/229; 250/326; 355/225

[58] Field of Search ..... 355/3 CH, 14 CH, 3 SH, 355/3 TR; 250/324–326; 361/229

[56] References Cited

U.S. PATENT DOCUMENTS 3,527,941 9/1970 Culhane et al. ..... 355/3 CH

FOREIGN PATENT DOCUMENTS 58-120282 7/1983 Japan .

*Primary Examiner*—A. T. Grimley
*Assistant Examiner*—J. Pendegrass
*Attorney, Agent, or Firm*—Wenderoth, Lind & Ponack

[57] ABSTRACT

A paper separation charger for separating papers from a photosensitive member in an electrophotographic copier includes a grid member disposed between a corona wire and the photosensitive member. The grid member is constructed so as to have a higher aperture efficiency at the upstream side of the grid in the paper transport direction than at the downstream side of the grid.

9 Claims, 6 Drawing Sheets

PAPER SEPARATION CHARGER FOR USE IN ELECTROPHOTOGRAPHIC COPIER AND THE LIKE

FIELD OF THE INVENTION

The present invention relates to a paper separation charger for use in electrophotographic copiers and the like, and more specifically relates to a scorotron type charger grid configuration.

BACKGROUND OF THE INVENTION

In electrophotographic copiers, an image formed on the photosensitive drum is transferred to the copy paper by means of a transfer charger. Thereafter, the paper is separated from the drum by means of a well known corona charger used as a separation device. Japanese Laid-Open Patent Application Sho B 58-120282 discloses a scorotron charger used as the separation charger, the scorotron charger having a grid electrode interposed between a corona wire and the object to be charged, and which controls the amount of charge by controlling the voltage applied to the grid.

SUMMARY OF THE INVENTION

A main object of the present invention is to provide a superior scorontron type separation charger.

A further object of the present invention is to provide a scorotron type separation charger with improved separation characteristics.

These and other objects are accomplished in accordance with the present invention by a scorotron charger provided with a grid formed so as to possess higher aperture efficiency on the upstream side than on the downstream side in the paper transport direction.

BRIEF DESCRIPTION OF THE DRAWINGS

The above and other objects of features of the present invention will become apparent from the following description of the preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Concrete examples of the separation charger of the present invention for use in electrostatic copy machines are described hereinafter with reference to the accompanying drawings.

FIRST EMBODIMENT

Figure 1:
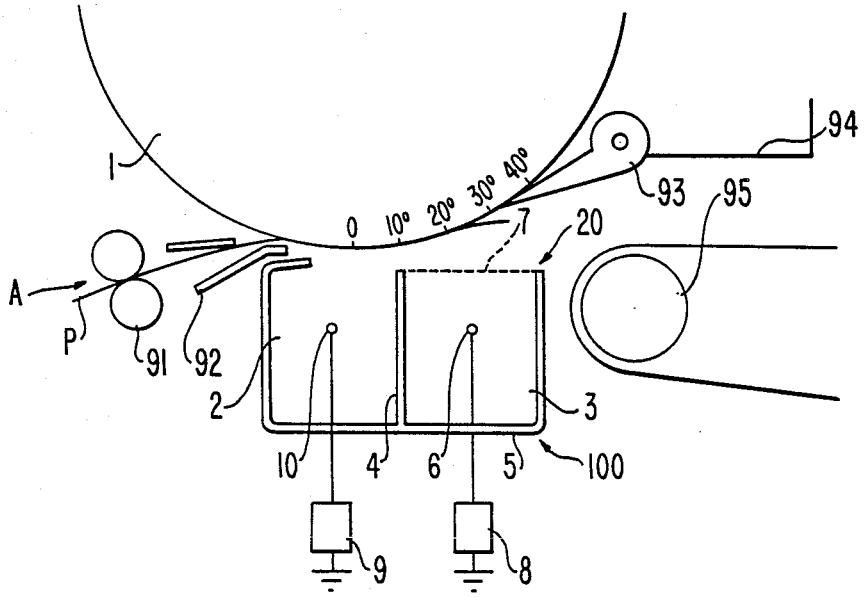
FIG. 1 is a plan view showing the transfer separation section of the copier according to a first embodiment of the present invention.
Figure 2:
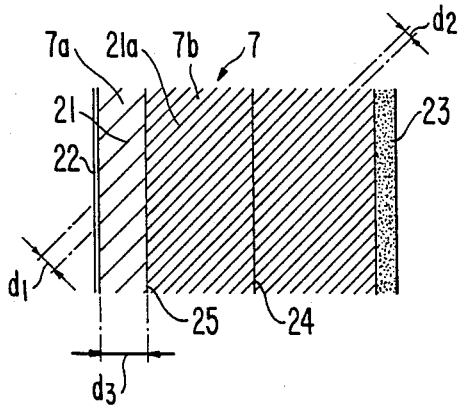
FIG. 2 is a plan view showing the grid configuration of the first embodiment.

FIG. 1 shows a simplified view of the essential portion of the separation charger of the present invention, and FIG. 2 shows a top view of the grid portion of the same embodiment.

The transfer separation section comprises a photosensitive member 1 which carries a toner image developed by a developing device not shown in the drawing, and a transfer charger 2 and a scorotron separation charger 3 disposed opposite thereto. This description is abbreviated as to the remaining elements, except for the aforesaid components, since the remaining elements surrounding the photosensitive member 1, namely transport roller 91, guide panel 92, separating pawl 93, cleaner 94, discharge device 95 and the like, are identical to well known components of conventional copy machines.

The scorotron separation charger 3 of the present invention has a housing 5 by which it is coupled with a transfer charger 2 through a center partition 4 so as to form a single unit, a charge electrode (or corona wire) for discharging electric charges 6 and a grid 7. Housing 5 may also be manufactured as separate units and then conjoined, rather than as a single unit and mounted to the body of the copy machine (not shown in the drawing), as in the present embodiment.

Grid 7, which covers the aperture portion 20 of the scorotron separation charger 3, is produced by an etching process, using a stainless steel plate as the material. As shown in FIG. 2 upstream and downstream portions 7*a* and 7*b* are formed by the parallel wire lines 21 and 21*a* arranged at an incline of 45° relative to the paper transport direction, fittings 22 and 23 being attached at either end and fixedly mounted to the ends of the housing 5 of the scorotron charger 3, not shown in the drawing, in the longitudinal direction. Grid portion 7 is thus emplaced at a specified height. Further, fittings 22 and 23 have a specific space interposed therebetween, and reinforcements 24 and 25 are disposed so as to be situated in parallel with fittings 22 and 23.

The aperture efficiency of grid 7 is greater on the upstream side than on the downstream side relative to the transport direction of copy paper P as shown by arrow "A" in FIG. 1. That is, grid 7 has an upstream portion 7*a* formed by parallel wire line 21 and a downstream portion 7*b* formed by parallel wire line 21*a*. The grid 7 has a thickness of 0.1 mm, with each parallel wire line 21 and 21*a* having a diameter of 0.1 mm. The parallel wire lines 21 are spaced with an internal d1 such that $d_1=0.2$ mm while the parallel wire lines 21*a* with an interval d2 such that $d_2=0.2$ mm (half the upstream interval). The entire width in the paper transport direction is 19 mm, while a width d3 of the upstream portion 7*a* is such that $d_3=4$ mm. Each of the wire lines are disposed at an incline angle of 45° relative to the paper transport direction.

The grid is disposed so as to cover the aperture portion 20 of the scorotron charger 3, and one end is grounded through contact with the center partition 4. Separation charger electrode 6 is connected to a positive polarity direct current (DC) high voltage transformer 8 used for separation. In addition, transfer charger electrode 10 is connected to a negative polarity high voltage transformer 9 used for transfer. The extent to which the aperture efficiency of grid 7 changes on the upstream and downstream sides, needless to say, depends upon changing a suitable value for the dimensional configuration of the scorotron separation charger, the position of the charger in relation to the photosensitive member 1, the voltage applied to the separation charger electrode 6, the voltage applied to the grid and the like.

Figure 3:
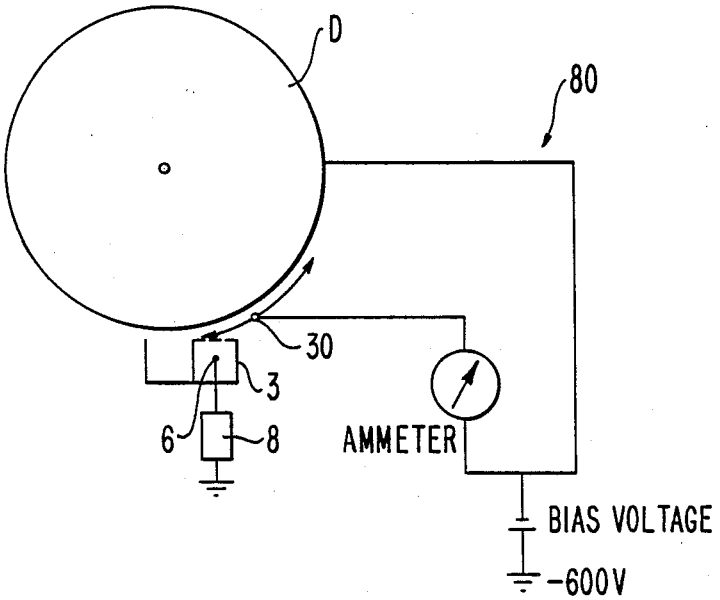
FIG. 3 is a plan view showing a corona discharge current distribution measuring device.

The corona discharge distribution of the scorotron separation charger 3 with the construction of the first embodiment described above was measured by a corona discharge current distribution measuring device 80 shown in FIG. 3. The voltage applied to the grid 0 V was set. Drum D used for the measurement was made of alumimum, and had a tungsten wire 30 movably disposed 0.3 mm above the drum D relative to the drum's axial direction, the wire 30 having a diameter of 50 μm. A DCHV transformer 8 was used as the high voltage transformer for separation.

A voltage Vs of 5.0, 5.5 and 6.0 kV was applied to the separation charger electrode 6, and the current was measured as it was received by the tungsten wire 30. In order to see the starting position of the discharge from the scorotron separation charger 3, the measurement was made while supplying a bias voltage of −600 V between drum D and the tungsten wire 30.

Figure 4:
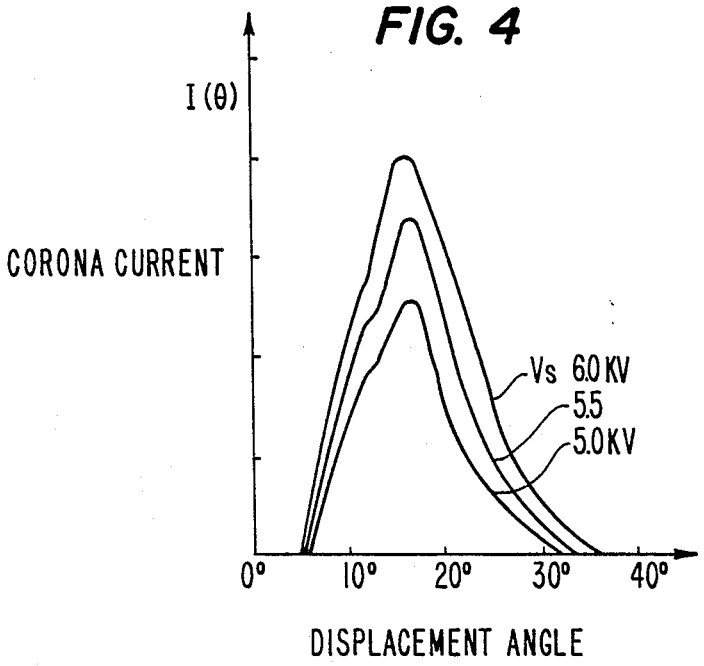
FIG. 4 is a graph showing the corona discharge current distribution for the separation charger obtained from the device of the first embodiment of the present invention.

The measurement results are shown in FIG. 4. Using the point of contact of the drum D and copy paper P as a reference, it was confirmed that when the central angle of the drum P in the direction of rotation is graduated in the sequence 10°, 20°, 30° and 40° (as shown in FIG. 1), the corona discharge current distribution on the surface of drum D is found in the region of 5° to 40° of the central angle.

When looking at the current distribution of the present embodiment, it is understood that the discharge to separate the copy paper from the surface of the photosensitive member is already started from the vicinity of 5°.

COMPARATIVE EXAMPLE

Figure 5:
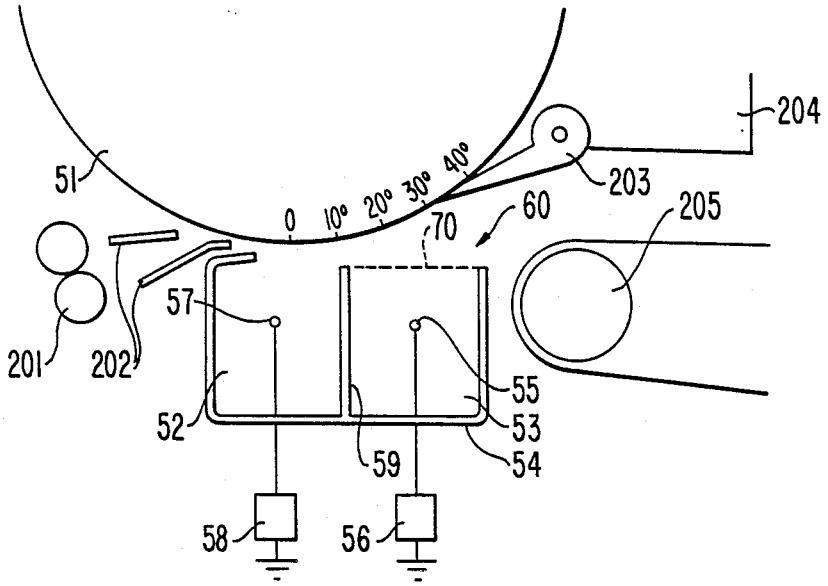
FIG. 5 (PRIOR ART)
FIG. 5 is a simplified view of a conventional device for the purpose of comparison.
Figure 7:
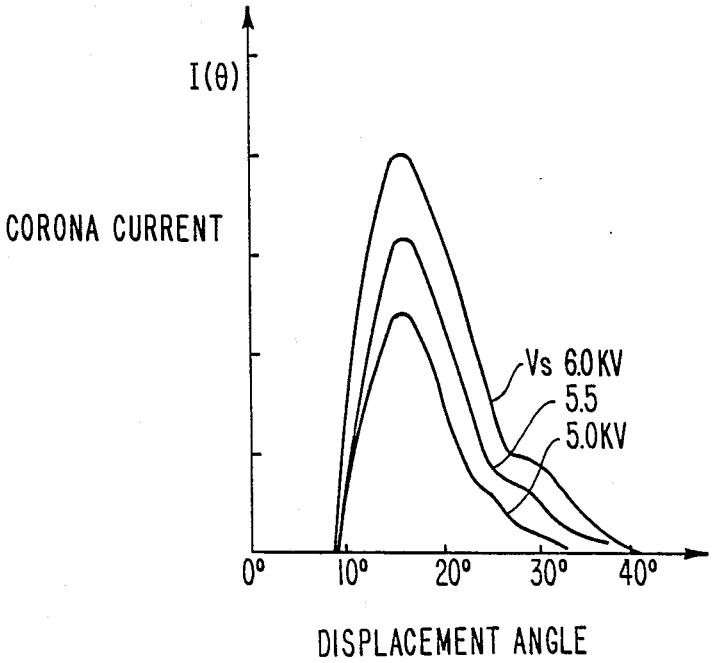
FIG. 7 (PRIOR ART)
FIG. 7 is a graph showing the results of current distribution for the conventional device as measured by the corona discharge current distribution measuring device shown in FIG. 3.
Figure 6:
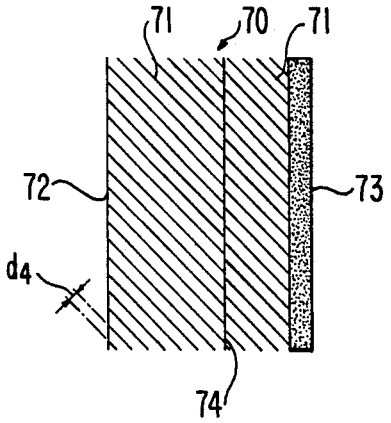
FIG. 6 (PRIOR ART)
FIG. 6 is a top view of the grid-like cover portion used in the comparative example of FIG. 5.

The device shown in FIG. 5 was produced to provide a comparative example. The basic construction, consisting of photosensitive member 51, transfer charger 52 and scorotron separation charger 53, is identical to the first embodiment, with the exception that configuration of the grid 70 attached to the aperture portion 60 of the scorotron separation charger 53 and the spacing interval d4 of the parallel wire lines 71 (refer to FIG. 6) differ from the first embodiment. That is to say, the spacing interval d4 of the parallel wire lines 71 is a uniform 10 mm so as to form a uniform pattern over the entire surface of grid 70, as shown in FIG. 6. The grid 70 is mounted on the partition 59 of the scorotron separation charger housing 54 by means of a fitting 72. The opposite end 73 is an unattached free end. In addition, a reinforcement 74 is provided at an intermediate point and parallel to the fitting and the free end. The charger electrode 55, shown in FIG. 5, is connected to a DC high voltage transformer 56 used for separation, and the transfer charger 52 and the discharge electrode 57 of the transfer charger 52 has connected thereto a high voltage transformer 58 of negative polarity used for transfer, in the same manner as the first embodiment.

The corona discharge current distribution of the separation charger was measured using the same measurement device 80 described in the first embodiment (refer to FIG. 3). Measurements were made with varied voltages of B 5.0, 5.5 and 6.0 kV applied to the separation charger electrode 55. In the present comparative example, virtually no current was generated for the charge elimination when the central angle above the photosensitive member 51 was between 0° and 10°. Therefore, the discharge starting position lay posterior to that of the first embodiment, The main cause for the lack of adequate current generation between the angles of 0° and 10° is believed to be due to an interruption occurring when the current of electrons travels toward the end of grid 70, which has a uniform pattern over its entire surface, caused by the current supplied from the charger electrode 55 to the photosensitive member 51 being introduced toward the end of the grid 70 at an oblique angle relative to the parallel wire lines 71.

Measurements of the discharge current distribution were conducted for the DC scorotron separation charger of the first embodiment and the comparative example, and identical results were also obtained when distribution was measured for an AC scrotron separation charger.

Both the discharge separation device produced in the first embodiment and the conventional discharge separation device produced in the comparative example were installed in identical electrostatic copy machines and actual paper transport tests were conducted. Although positive polarity DC transformers were used for separation in the current distribution measurements in these tests, conversion to a separation method using an AC transformer is also possible. The width of the grid 7 (70) in the paper transport direction was 19 mm. Further, the voltage (Vs) applied to the separation charger electrode 6 (55) was varied from 4.0, 4.5, 5.0, 5.5., 6.0 and 7.5 kV for the purposes of the test.

A white chart and a character chart (black area 6%), were used to evaluate separation characteristics. When the separation characteristics were poor, i.e., when the leading edge of the white chart came into contact with the separation claw or cleaner bottom and became soiled, a value of "X" was given, but if contact was not made, a value of "0" was given. The character chart was used to evaluate for separation marks (defective copying at the leading edge of the copy material caused by the discharge) rather than separation characteristics; when such marks were present, a value of "X" was given, and when absent, a value of "0" was given. The results of the paper transport test are shown in Table 1.

TABLE 1

| | Type | | | | | |
|---|---|---|---|---|---|---|
| | (Conventional) Uniform Pattern Grid | | | Grid of Present Invention | | |
| Vs (kV) | White Chart Separation | Char. Separ. | Chart Marks | White Chart Separation | Char. Separ. | Chart Marks |
| 4.0 | X | X | X | X | X | X |
| 4.5 | X | X | 0 | X | 0 | 0 |
| 5.0 | X | X | 0 | 0 | 0 | 0 |
| 5.5 | X | X | X | 0 | 0 | 0 |
| 6.0 | X | X | X | 0 | 0 | 0 |
| 6.5 | X | X | X | 0 | 0 | 0 |

The results of the paper transport test are described in Table 1. The conventional device received "0" values for character separation marks when the voltage applied to the charger electrode was 4.5 and 5.0 kV, but received "X" values at all other settings.

On the other hand, the first embodiment of the invention received "X" values for white chart separation characteristics and character chart separation characteristics and separation marks when the applied voltage was 4.0 kV, and an "X" value for white chart separation characteristics when the applied voltage was 4.5 L kW. However, all "0" values were received for white chart separation characteristics and character chart separation characteristics and separation marks when the applied voltage was 5.0, 5.5, 6.0 and 6.5 kV.

Thus, it is concluded that the discharge separation device of the first embodiment of the present invention possesses clearly excellent separation characteristics as compared to the comparative example employing a uniform pattern grid.

FIRST MODIFICATION

Figure 8:
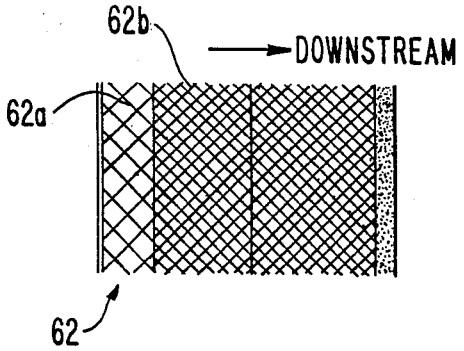
FIG. 8 shows a first modified embodiment having a mesh-like grid cover portion.
Figure 11:
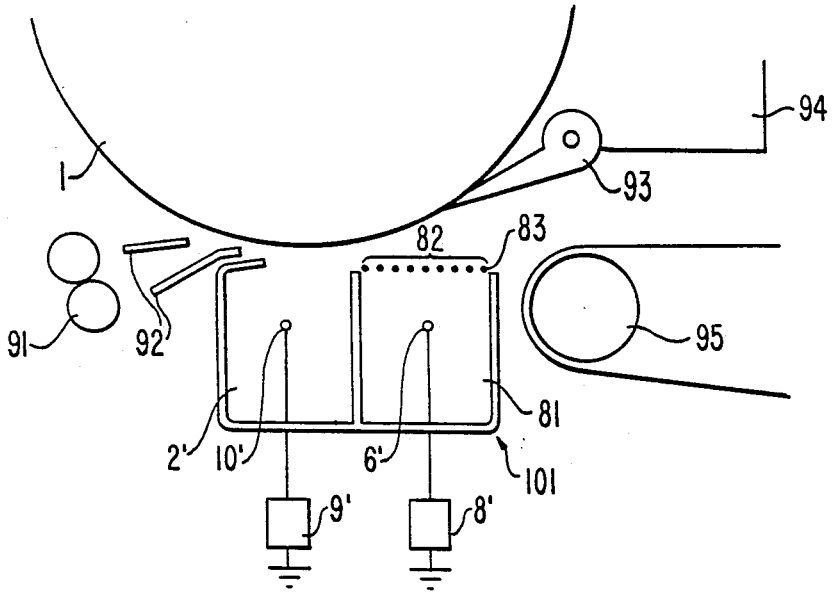
FIG. 11 is a simplified view of the essential portion of the invention showing the second embodiment of the separation charger of the present invention.

The basic construction of the separation device of the present modification is idential to that of the first embodiment. The device of the present modification has a mesh-shaped grid 62, as shown in FIG. 8, with the mesh portion 62*a* having a greater aperture efficiency than the mesh portion 62*b*. The mesh portions 62*a* and 62*b* are formed so as to be oblique relative to the paper transport direction, as in the first embodiment.

SECOND MODIFICATION

Figure 9:
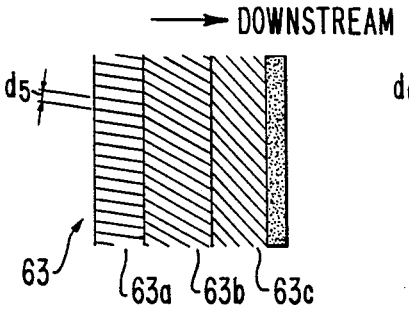
FIG. 9 shows a second modified embodiment having a changed aperture efficiency for the grid portion.
Figure 10:
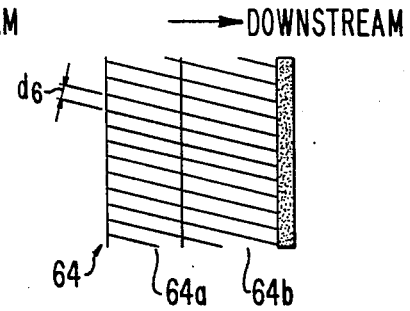
FIG. 10 shows a third modified embodiment having a changed aperture efficiency for the grid portion.

The basic construction of the separation device of the present modification is identical to that of the first embodiment. The device of the present modification has a grid 63 formed by the parallel wire lines 63*a*, 63*b*, 63*c*, as shown in FIG. 9, with the same spacing intervals d5. The angles of inclination for each of lines 63*a*, 63*b*, 63*c* are changed each other so as to increase from the upstream side to the downstream side with respect to the paper transport direction.

THIRD MODIFICATION

The basic construction of the separation device of the present modification is identical to that of the first embodiment. The device of the present modification has a grid 64formed by the parallel wire lines 64*a* and 64*b*, each having the same spacing interval d6, but with different diameters.

SECOND EMBODIMENT

The discharge separation device 101 of a second embodiment has a grid 82 formed by a plurality of wires 83 of a specific diameter which are mutually adjoined and disposed in the direction of paper transport. The spacing of the upstream wires 83 in the direction of paper transport is greater than that downstream. The charging electrode 6' of the scrotron separation charger 7 is connected to a DC high voltage transformer 8' of positive polarity used for separation. The charging electrode 10' of the transfer charger 2 is connected to a DC high voltage transformer 9' of negative polarity used for transfer. The present embodiment was subjected to the same separation charger corona discharger current distribution measurements and paper transport tests as was the first embodiment and comparative example. The results were virtually the same as for the first embodiment, and superior separation characteristics are obtained compared to conventional devices.

THIRD EMBODIMENT

Figure 12:
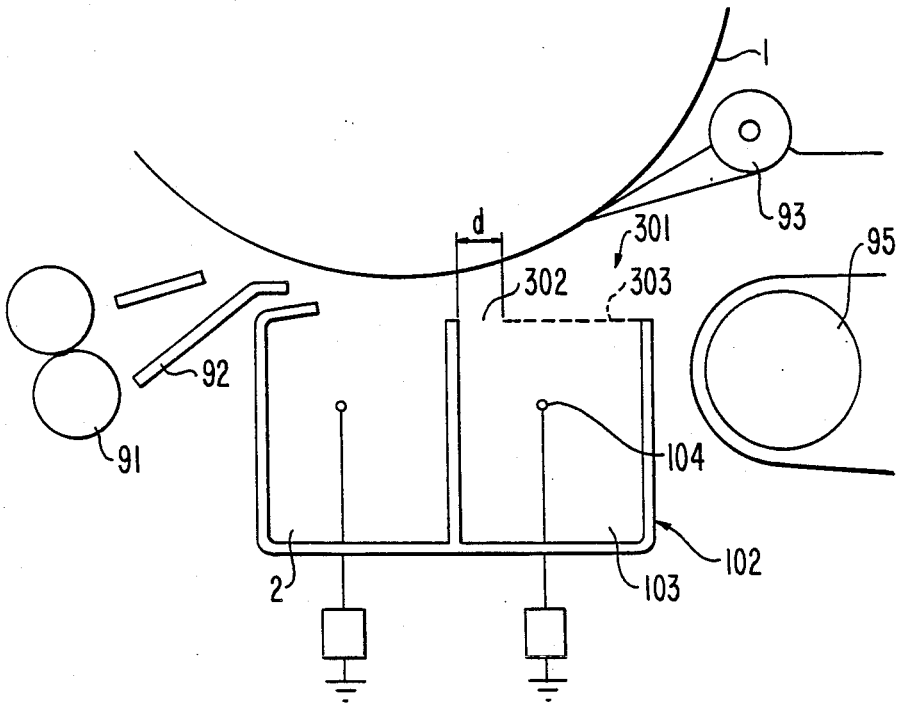
FIG. 12 is a simplified view of the essential portion of the invention showing a third embodiment of the separation charger of the invention.
Figure 13:
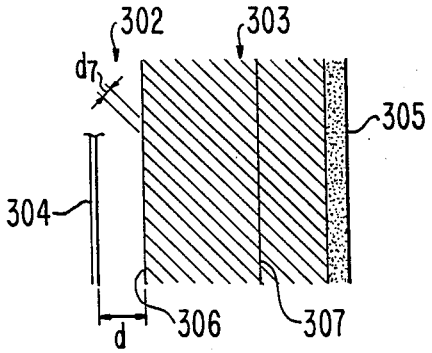
FIG. 13 shows a top view of the grid portion of the embodiment of FIG. 12.

Referring to FIGS. 12, 13, grid 301 of a third embodiment has a no-wire portion 302 on the upstream side, a wire portion 303 on the downstream side, fittings 304, 305 and reinforcements 306, 307. The no-wire portion 302 has a width d such that $d_8=4$ mm and the wire portion 303 has a plurality of parallel wire lines with the same dimensions as the wire lines 7*b* described in the first embodiment. The discharge separation charger 102 of the third embodiment was subjected to paper transport tests in the same manner as the first and second embodiments while the length of the no-wire portion d was varied, and the voltage (V3) applied to the separation charger electrode 104 was also varied at 3.5, 4.0, 4.5, 5.0, 5.5, 6,0 and 6.5 kV.

A white chart and a character (black area 6%) were used to evaluate separation characteristics. When the separation characteristics were poor, i.e., when the leading edge of the white chart came into contact with the separation claw or cleaner bottom and became soiled, a value of "X" was given, but if contact was not made, a value of "0" was given. The character chart was used to evaluate for separation marks (defective copying at the leading edge of the copy material caused by the discharge) rather than separation characteristics; when such marks were present, a value of "X2 was given, and when absent, a value of "0" was given. The results of the paper transport test are shown in Table 2.

TABLE 2

| | Type | | | | | | | | | | | | | | |
|---|---|---|---|---|---|---|---|---|---|---|---|---|---|---|---|
| | d = 2 mm | | | d = 4 mm | | | d = 6 mm | | | d = 8 mm | | | d = 10 mm | | |
| | W | C | | W | C | | W | C | | W | C | | W | C | |
| VS (KV) | S | S | M | S | S | M | S | S | M | S | S | M | S | S | M |
| 3.5 | X | X | X | X | X | X | X | X | X | X | X | X | X | O | O |
| 4.0 | X | X | X | X | X | O | X | O | O | O | O | O | X | O | O |
| 4.5 | X | X | O | X | O | O | O | O | O | O | O | O | X | O | O |
| 5.0 | X | O | O | O | O | O | O | O | O | X | O | O | X | O | O |
| 5.5 | O | O | O | O | O | O | O | O | O | X | X | X | X | O | O |
| 6.0 | O | O | X | O | O | O | X | O | O | X | X | X | X | O | O |

TABLE 2-continued

| | Type | | | | | | | | | | | | | | |
|---|---|---|---|---|---|---|---|---|---|---|---|---|---|---|---|
| | d = 2 mm | | | d = 4 mm | | | d = 6 mm | | | d = 8 mm | | | d = 10 mm | | |
| | W | C | | W | C | | W | C | | W | C | | W | C | |
| VS (KV) | S | S | M | S | S | M | S | S | M | S | S | M | S | S | M |
| 6.5 | X | X | X | O | O | O | X | X | X | X | X | X | X | O | O |

W: White chart
C: Character chart
S: Separation characteristics
M: Separation marks With the length d of the no-wire portion 302 at 2 mm, the white chart separation characteristics, character chart separation characteristics and separation marks all received "0" values when the voltage applied to the charger electrode 104 was 5.5 kV.

With the length d set at 4 mm, the white chart separation characteristics, character chart separation characteristics and separation marks all received "0" values when the voltage applied to the charger electrode 104 was 5.0, 5.5, 6.0 and 6.5 KV.

With the length set at 6 mm, the white chart separation characteristics, character chart separation characteristics and separation marks all received "0" values when the voltage applied to the charger electrode 104 was 4.5, 5.0 and 5.5 kV.

With the length d of the no-wire portion 302 at 8 mm, the white chart separation characteristics, character chart separation characteristics and separation marks all received "0" values when the voltage applied to the charger electrode 104 was 4.0 and 4.5 kV. However, a case wherein the white chart separation characteristics, character chart separation characteristics and separation marks all received "0" values irrespective of the applied voltage when the length d was set at 10 mm, was not observed.

It is therefore concluded that a length d of 8 mm or less for the aperture portion 302 is desirable.

The discharge separation device for electrostatic copy machine of the present invention is provided with a scorotron separation charger having a grid aperture portion that is non-uniform in configuration, an has a higher aperture efficiency at the upstream side in the direction of paper transport than at the downstream side. That is to say, the corona discharge current distribution of the scorotron separation charger was based on the point of contact of the copy paper and the photosensitive member, the central angle toward the direction of rotation of the photosensitive member was set to a specified angular region suitable for separation, and the deviation of the current distribution was toward the upstream side of paper transport. Thus, the separation characteristics from side to side at the start of discharge could be accelerated and the separation characteristics were markedly improved.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper separation charger for use in electrophotographic copiers for separating papers from a photosensitive member, comprising:

a corona wire for discharging electric charges toward said photosensitive member;

a housing enclosing said corona wire, said housing having an aperture portion at a side of said housing facing said photosensitive member; and a grid member disposed at said aperture portion of said housing for regulating the amount of said electric charges travelling toward said photosensitive member, said grid member having a higher aperture efficiency at the upstream side of said grid member with respect to the paper transport direction of said photosensitive member than at the downstream side of said grid member.

2. The paper separation charger as claimed in claim 1, wherein said grid member comprises a first portion having said higher aperture efficiency and a second portion having a lower aperture efficiency than said first portion.

3. The paper separation charger as claimed in claim 2, wherein said first portion and said second portion both comprise a plurality of parallel wires.

4. The paper separation charger as claimed in claim 3, wherein the interval between the parallel wires of said first portion is larger than the interval between the parallel wires of said second portion.

5. The paper separation charger as claimed in claim 3, wherein the parallel wires of said first portion are disposed at a first angle of inclination with respect to said paper transport direction, and the parallel wires of said second portion are disposed at a second angle of inclination with respect to said paper transport direction, said second angle of inclination being different from said first angle of inclination.

6. The paper separation charger as claimed in claim 2, wherein:

said first portion of said grid member and said second portion of said grid member are mesh.

7. The paper separation charger as claimed in claim 2, wherein:

said first portion of said grid member comprises a vacant area.

8. The paper separation charger as claimed in claim 1, wherein:

said grid member comprises a plurality of parallel wires extending perpendicular to said paper transport direction, the intervals between said parallel wires decreasing from said upstream side of said grid member toward said downstream side of said grid member.

9. A paper separation charger for use in electrophotographic copiers for separating papers from a photosensitive member, comprising:

a corona wire for discharging electric charges toward said photosensitive member;

a housing enclosing said corona wire, said housing having an aperture portion at a side of said housing facing said photosensitive member; and a grid means disposed at said aperture portion of said housing for regulating the amount of said electric charges travelling toward said photosensitive member, said grid means having a higher aperture efficiency at the upstream side of said grid means with respect to the paper transport direction of said photosensitive member than at the downstream side of said grid means.

* * * * *